United States Patent [19]

Bamsey et al.

[11] 4,134,377

[45] Jan. 16, 1979

[54] EXHAUST GAS RECIRCULATION CONTROL VALVE AND HEAT EXCHANGER

[75] Inventors: Robert G. Bamsey, Kitchener; Dirk B. van der Male, Cambridge, both of Canada

[73] Assignee: Borg-Warner Corporation, Chicago, Ill.

[21] Appl. No.: 837,784

[22] Filed: Sep. 29, 1977

[51] Int. Cl.[2] ..... F02B 27/00

[52] U.S. Cl. ..... 123/119 A

[58] Field of Search ..... 123/119 A; 165/51; 60/278

[56] References Cited

U.S. PATENT DOCUMENTS

| | | | |
|---|---|---|---|
| 2,453,877 | 11/1948 | Trail | 60/337 |
| 3,024,773 | 3/1962 | Yamaoka | 165/51 X |
| 3,426,841 | 2/1969 | Johnson | 165/178 |
| 3,834,366 | 9/1974 | Kingsbury | 123/119 A |
| 3,868,934 | 3/1975 | Mick | 123/119 A |
| 3,937,196 | 2/1976 | Cook et al. | 123/119 A |
| 3,941,105 | 3/1976 | Yagi et al. | 123/119 A |
| 3,948,315 | 4/1976 | Powell | 165/70 |
| 3,992,878 | 11/1976 | Moorman | 123/119 A X |
| 4,011,845 | 3/1977 | Mayer et al. | 123/119 A |

*Primary Examiner*—Carlton R. Croyle
*Assistant Examiner*—Leonard E. Smith
*Attorney, Agent, or Firm*—James A. Geppert

[57] ABSTRACT

A combination control valve and heat exchanger for the exhaust gas recirculated from the exhaust manifold of an internal combustion engine to the carburetor thereof wherein the combination unit is compact and adapted to be mounted on the intake manifold or a spacer plate below the carburetor. The heat exchanger has a plurality of U-shaped tubes to receive the exhaust gas and reduce the temperature level thereof before it reaches the control valve metering the quantity of exhaust gas returned to the combustion cycle.

12 Claims, 2 Drawing Figures

EXHAUST GAS RECIRCULATION CONTROL VALVE AND HEAT EXCHANGER

BACKGROUND AND SUMMARY OF THE INVENTION

The present invention relates to the recirculation of exhaust gas from the combustion cycle and the cooling of the recycled gas before it is returned to the combustion cycle of an internal combustion engine through the carburetor thereof.

Since the early 1970's, the automobile manufacturers have been required to reduce the emissions and/or pollutants resulting from the combustion cycle of an internal combustion engine. Various components have been added to the engine to control emissions including positive crankcase ventilation, exhaust gas recirculation, an evaporation control system and a catalytic converter in the exhaust line.

The emissions from the exhaust gases of automobile engines have been blamed for conditions such as smog occurring primarily in large cities, and one such emission of great concern are the oxides of nitrogen. An exhaust gas recirculation cycle has been used to reduce these oxides as the formation of nitrogen oxides takes place at the peak temperature period of the combustion process, and a temperature reduction can be accomplished by introducing small amounts of an inert gas into the combustion process. As the end products of combustion provide a continuous supply of relatively inert gas, the recirculation of the exhaust gases in the correct proportions to the engine carburetor accomplished the desired emission reduction.

As the exhaust gases from the exhaust manifold of an internal combustion engine are at a very high temperature level, a heat exchanger may be inserted in the recirculation passage to cool the exhaust gases returning to the combustion cycle. However, in view of the crowded condition of the internal combustion engine and related equipment in the engine compartment of an automotive vehicle, the insertion of a heat exchanger of sufficient size to provide the necessary cooling capacity for the exhaust gases becomes extremely difficult in view of the alignment of fittings, etc. The present invention provides a solution to the problem of providing sufficient space for the heat exchanger.

The present invention comprehends the provision of a compact heat exchanger in combination with an exhaust gas recirculation control valve where the unit is adapted to be connected to the intake manifold of the engine so that the cooled exhaust gases directly enter the intake manifold for mixing with ambient air and gasoline vapor proceeding through the carburetor to the combustion chambers of the engine. The exhaust gases exit from the exhaust manifold through generally internal passages to reach the heat exchanger.

The present invention also comprehends the provision of a compact heat exchanger in combination with an exhaust gas recirculation control valve in an integral housing whereby the passageway from the heat exchanger to the intake manifold is controlled by the exhaust gas recirculation valve. The control valve housing is mounted on a valve body containing the gas inlet and outlet passages leading to a heat exchanger laterally removed from the valve housing. This combination eliminates all need for external exhaust gas piping and potential sources of leakage at external connections.

The present invention further comprehends the provision of a compact heat exchanger combined with an exhaust gas recirculation control valve wherein the heat exchanger includes a plurality of U-shaped tubes through which the hot exhaust gases pass housed in a shell having cooling water inlet and outlet connections that communicate with the coolant from the engine cooling system.

Another object of the present invention is the provision of a combined exhaust gas recirculation control valve and a heat exchanger whereby the control valve and heat exchanger can be easily tested and calibrated prior to assembly to the vehicle engine.

Further objects are to provide a construction of maximum simplicity, efficiency, economy and ease of assembly and operation, and such other objects, advantages and capabilities as will later more fully appear and are inherently possessed thereby.

DESCRIPTION OF THE PREFERRED EMBODIMENT

Figure 1:
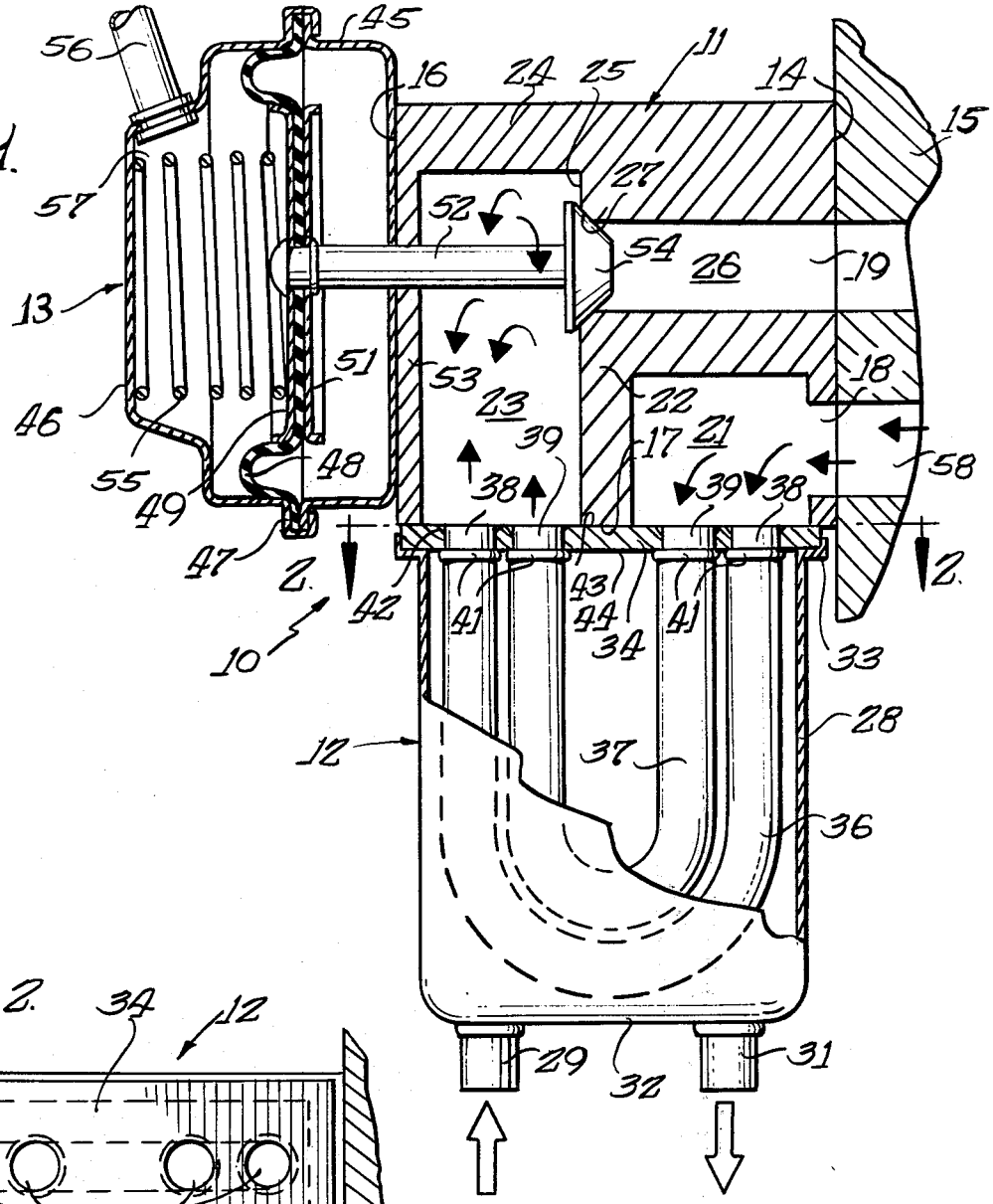
FIG. 1 is a cross-section view through the combined exhaust gas recirculation control valve and heat exchanger mounted on an engine intake manifold.
Figure 2:
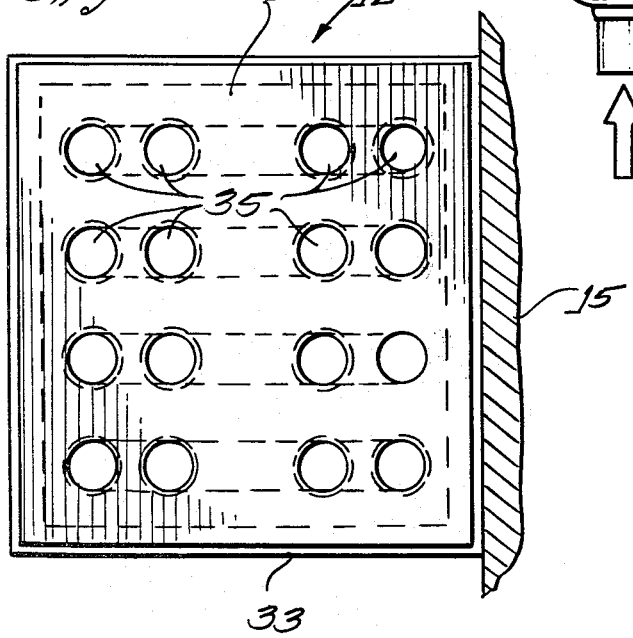
FIG. 2 is a cross sectional view taken on the line 2—2 of FIG. 1.

Referring more particularly to the disclosure in the drawings wherein is shown an illustrative embodiment of the present invention, FIG. 1 discloses an assembly 10 combining a valve body 11, a heat exchanger 12 and an exhaust gas recirculation control valve 13; the valve body 12 having a surface 14 adapted to contact and sealingly engage the intake manifold or carburetor spacer plate 15 for an internal combustion engine (not shown) of an automotive vehicle. The control valve 13 engages a surface 16 of the valve body directly opposite to the surface 14, and the heat exchanger 12 engages a third surface 17 of the body. All of these components are suitably secured to each other and to the intake manifold or spacer plate 15.

The valve body 11 has a gas inlet port 18 and a gas outlet port 19 in the surface 14, with the inlet port opening into a generally rectangular gas distribution chamber 21 which is open at the lower surface 17 for communication with the heat exchanger 12. A central generally L-shaped partition 22 in the valve body 11 separates the chamber 21 from a second generally rectangular gas collection chamber 23 opening at the surface 17 and extending through the body to terminate short of the opposite wall 24. A wall surface 25 of the partition 22 extends from surface 17 to the wall 24 to separate the chamber 23 from the gas outlet passage 26 leading to the outlet port 19; the wall surface 25 having an opening forming a valve seat 27 cooperating with the EGR (exhaust gas recirculation) control valve 13.

The heat exchanger 12 includes an outer shell or housing 28 with a water inlet port 29 and a water outer port 31 in the bottom wall 32 of the shell; the top of the shell having a flanged shoulder 33 to receive a tube header or plate 34. The header is suitably sealed to the valve body 11 by a gasket (not shown) and secured thereto. A plurality of openings 35 in the header are arranged in rows to receive the ends 38,39 of a series of U-shaped tubes 36, 37 arranged in a double row in parallel. The tubes 36, 37 are positioned in a coplanar nested manner with the tubes 36 having a larger U-bend than the tubes 37 as seen in FIG. 1.

The ends 38, 39 of the tubes are located in the header in parallel rows communicating with the chambers 21 and 23 to provide for the flow of hot exhaust gas therethrough. Each tube 36 or 37 has a bead or enlargement 41 formed short of the tube end 38 or 39 to position the tube in the header, and the tube end is flared outwardly as shown at 42. The openings 35 in the header having a flared portion at the outer surface 43 abutting the valve body 11 complementary to the flared end 42, and the enlarged beads 41 are located at the inner surface 44 to cooperate with the flared ends in retaining the tube ends 38, 39 in the header.

The EGR control valve 13 includes a valve housing 45 abutting the valve body surface 16 and having a generally cylindrical hollow configuration and a reduced diameter upper end 46. The body 45 may be formed in two parts joined at a seam 47 which will also act to clamp the outer periphery of a diaphragm 48. A pair of diaphragm backing plates 49, 51 are secured together on opposite sides of the central portion of the diaphragm 48 and a valve stem 52 is suitably secured to the plates. The valve stem 52 extends through the housing 45 and the wall 53 at surface 16 into the valve body and is sealingly mounted for reciprocation therein. The stem extends into the chamber 23 and terminates in an enlarged valve end 54 complementarily received in the valve seat 27 in wall surface 25.

A compression spring 55 is housed in the upper end 46 and biases the diaphragm towards the valve body 11 to seat the valve end 54 in the valve seat 27. A vacuum outlet 56 communicates with the valve housing 45 in the closed chamber 57 behind the diaphragm 48 to control actuation of the valve 54; the housing in front of the diaphragm being vented to the atmosphere.

Considering the operation of the present assembly, the intake manifold or spacer plate 15 is provided with a passage 58 communicating with the exhaust manifold of the engine (not shown) and the vacuum outlet 56 is connected to a source of vacuum created by operation of the engine. The water inlet port 29 in the heat exchanger is positioned generally diagonally opposite the exhaust gas inlet ends of the tubes 36, 37, and the water outlet port 31 is likewise generally diagonally opposite the gas outlet ends of the tubes. Thus, the water flow in the heat exchanger is generally countercurrent to the gas flow in the tubes for an efficient heat transfer operation; the cooled water being circulated from the radiator for the engine.

When the engine is off, the spring 55 urges the diaphragm 48 inward to close the valve 54 in its seat 27. With the engine operating, as the throttle is opened, the vacuum from the engine source will increase creating a vacuum behind the diaphragm 48 in valve chamber 57 to cause the diaphragm to overcome the force of the spring 55 and withdraw the valve 54 from the valve seat 27. As the opening forming the valve seat is uncovered, exhaust gas will be allowed to circulate from passage 58 and through the inlet port 18, chamber 21, U-tubes 36, 37, chamber 23, opening in wall surface 25, passage 26 and outlet port 19 to the intake manifold to be mixed with incoming air and fuel from the carburetor. The exhaust gas is effectively cooled in the heat exchanger 12 due to the flow of coolant within the shell 28 and around the tubes 36 and 37. Variations in the vacuum from the engine source will result in changing the position of the valve 54 in the valve seat 27 to control the quantity of exhaust gas recirculated to the intake manifold.

While an exhaust gas recirculation control valve of a particular design has been shown and described for use in the above assembly, it is not our intent to unnecessarily restrict the improvement by virtue of this limited showing. Other designs of EGR control valves can be modified to be assembled with the valve body and cooler in the above described unit.

We claim:

1. In combination with an intake manifold for an internal combustion engine, a heat exchanger and an exhaust gas recirculation control valve, the control valve including a valve body and a valve housing, the valve body connecting the heat exchanger and the valve housing to the intake manifold and having an exhaust gas inlet leading to the heat exchanger and an exhaust gas outlet for the cooled exhaust gases.

2. The combination as set forth in claim 1, in which said valve body includes a gas distribution chamber and a gas collection chamber communicating with said heat exchanger and with said gas inlet and gas outlet, respectively.

3. The combination as set forth in claim 2 in which said heat exchanger includes a housing, a tube header, and a plurality of U-shaped tubes, each tube having one end communicating with the gas distribution chamber and the opposite end communicating with the gas collection chamber.

4. The combination as set forth in claim 3, in which said U-shaped tubes are arranged in a row with the tubes being parallel.

5. The combination as set forth in claim 3, in which said tubes are separated into inner and outer tubes in a common plane, said tubes being arranged in a row in a parallel fashion.

6. The combination as set forth in claim 3, in which said housing has a coolant inlet and a coolant outlet arranged thereon to provide a coolant flow generally countercurrent to the exhaust gas flow through said U-shaped tubes.

7. The combination as set forth in claim 2 including a valve seat formed in said valve body to control gas flow from the heat exchanger to said gas outlet, and a valve member in said body cooperating with said valve seat.

8. The combination as set forth in claim 7, in which said valve housing includes a resilient diaphragm, a valve stem connected at one end to said diaphragm and terminating at the opposite end in said valve member.

9. The combination as set forth in claim 8, wherein said valve housing above said diaphragm communicates with a source of vacuum created by operation of the engine.

10. The combination as set forth in claim 1, in which said valve body includes a gas distribution chamber communicating with said exhaust gas inlet and said heat exchanger, a gas collection chamber communicating with said heat exchanger, a gas outlet passage extending between said gas collection chamber and said exhaust gas outlet, a valve seat separating said gas collection chamber and said gas outlet passage, a resilient diaphragm in said valve housing, a valve stem operatively connected to said diaphragm and extending into said valve body to terminate in a valve member received in said valve seat, and said heat exchanger including a housing, a tube header mounted in said housing in sealing contact with said valve body, a plurality of U-shaped tubes having their ends secured in said tube header, one end of each tube communicating with said gas distribution chamber and the opposite end communicating with the gas collection chamber, a coolant inlet and a coolant outlet in said housing providing a fluid flow in said housing generally countercurrent to the gas flow in said tubes.

11. The combination as set forth in claim 10, in which said U-shaped tubes are arranged in a row with the tubes being oriented in parallel fashion, said tube header having a plurality of openings receiving the ends of the tubes, each tube end having an enlarged bead adjacent the end to abut the tube header and a flared end portion to retain the tube end in the header.

12. The combination as set forth in claim 10, in which said valve housing between said diaphragm and said valve body is vented to atmosphere, and the valve housing on the opposite side of said diaphragm is closed and operatively communicates with a source of vacuum created by operation of the engine.

* * * * *